United States Patent [19]

Simonette

[11] Patent Number: 5,035,580

[45] Date of Patent: Jul. 30, 1991

[54] BYPASS MODE CONTROL FOR HIGH PRESSURE WASHING SYSTEM

[75] Inventor: Dallas W. Simonette, Blaine, Minn.

[73] Assignee: Diversified Dynamics Corporation, Minneapolis, Minn.

[21] Appl. No.: 407,241

[22] Filed: Sep. 14, 1989

[51] Int. Cl.[5] ..... F04B 49/00

[52] U.S. Cl. ..... 417/34; 91/49

[58] Field of Search ..... 417/34; 91/49, 422, 91/222, 394, 224, 226; 137/115; 60/431

[56] References Cited

U.S. PATENT DOCUMENTS

| | | | |
|---|---|---|---|
| 3,213,605 | 10/1965 | Welden | 60/431 |
| 3,270,729 | 9/1966 | Swatek, Jr. et al. . | |
| 3,987,625 | 10/1976 | Swatty et al. . | |
| 4,024,711 | 5/1977 | Russell, Jr. . | |
| 4,238,073 | 12/1980 | Liska | 417/34 |
| 4,492,525 | 1/1985 | Bilyeu . | |
| 4,523,431 | 6/1985 | Budzich . | |
| 4,549,400 | 10/1985 | King . | |
| 4,588,357 | 5/1986 | McGraw et al. . | |
| 4,870,889 | 10/1989 | Wall | 91/49 |

*Primary Examiner*—Leonard E. Smith
*Assistant Examiner*—David W. Scheuermann
*Attorney, Agent, or Firm*—Merchant, Gould Smith, Edell, Welter & Schmidt

[57] ABSTRACT

A pressure washing system is disclosed which consists of a hydraulic pump driven by a variable speed internal combustion engine, a nozzle gun connected to the pump outlet, an unloader valve that senses the demand state of the nozzle gun for delivering water under pressure to the gun on demand, and for recirculating water to the pump inlet when the gun is in a non-demand position, and a throttle control device. The throttle control device senses pump outlet pressure and controls engine speed as a function of the demand/non-demand mode of the nozzle gun. Water is accordingly delivered at a high flow rate to the nozzle gun in the demand state, but recirculated at a much lower flow rate when the nozzle gun is in a demand state. The throttle control device also senses fluid pressure from the pump outlet to operate between engine starting and engine running modes. When hydraulic pressure is 0 or less than a predetermined threshold pressure, water is bypassed through a low-pressure hydraulic circuit to reduce the engine load during a manual start. After the engine has been started and the pump reaches the threshold pressure, the throttle control device operates to control the engine speed.

17 Claims, 2 Drawing Sheets

BYPASS MODE CONTROL FOR HIGH PRESSURE WASHING SYSTEM

The invention is directed to a control device for producing mechanical motion in response to increasing fluid pressure after a predetermined minimum pressure has been reached, and a hydraulic control system such as a pressure washing system in which the control apparatus is utilized.

Portable high pressure washing systems typically consist of a hydraulic pump driven by an internal combustion engine, with an orifice-type nozzle gun connected to the pump outlet. It is well known to include in the hydraulic system an unloader valve disposed between the pump outlet and nozzle gun that directs pressurized fluid to the nozzle gun when the gun is in a demand state, and which recirculates or bypasses pressurized fluid directly to the pump inlet when the nozzle gun is in a no demand state. In many prior art systems, the engine runs at full throttle during both the supply and bypass modes. However, water circulated under a high flow rate generates a high temperature in the system, which adversely affects the pump seals.

For example, U.S. Pat. No. 3,213,605, which issued to A. J. Welden on Oct. 26, 1965, discloses a closed hydraulic system in which pressurized hydraulic fluid is used to actuate a hydraulic appliance (pruning shears). Hydraulic fluid is circulated through a bypass circuit when the appliance is in a no-demand state, and the engine is operated at a lower speed during such time. A demand state is created by a manual actuation of a control valve, which blocks the bypass circuit and causes hydraulic pressure in the system to increase, which in turn actuates the hydraulic appliance. At the same time, increased hydraulic pressure in the system causes engine speed to increase. Although this patent discloses the concept of hydraulic fluid recirculation at lower engine speeds, it does not discuss or contemplate the heat problem encountered in high pressure washing systems as discussed above.

Another problem with portable high-pressure washing systems of this type is difficulty in starting the engine due to the load of the hydraulic system. The internal combustion engine in many high-pressure washing systems is manually started (e.g., a rope pull device, which is extremely difficult to operate against the load of the hydraulic system. One solution to this problem has been to establish another bypass circuit that causes water to recirculate through the pump at lower pressure when the engine is in an inoperative state or at idling speed, and to block such recirculation at the time engine speed is increased. The fluid pressure in this recirculating mode is relatively low, which enables the engine to be manually started much more easily.

This invention is directed to an inventive device that uniquely combines the low pressure manual start function with an engine speed control function. In the preferred embodiment, the device consists of a body defining an elongated chamber with a fluid inlet at one axial end and an outlet that enters the side of the chamber. A piston assembly is disposed in the chamber and is movable in response to fluid pressure at the inlet between first and second positions. The piston assembly is normally biased to the first position.

An actuator taking the form of a rod connected to the piston assembly produces usable mechanical motion as a function of movement of the piston. More specifically, the actuator rod is connected to the throttle cable for the internal combustion engine, and operates to control the engine at an idling speed with the piston assembly in the first position, and to increase the engine speed to full throttle when the piston assembly is in the second position.

A pressure actuated, normally open valve is carried by the piston assembly, and communicates with the fluid inlet. When the valve means is open (its normal state), it establishes fluid flow between the inlet and outlet of the elongated chamber. The valve means is open when pressure at the fluid inlet is between 0 and a predetermined threshold pressure. This pressure range determines the bypass mode for the control device, so that fluid flows from the inlet through the device to the outlet, from which point it is recirculated back to the pump inlet. It is this bypass, low pressure mode that permits the internal combustion engine to be started more easily.

When the threshold pressure is reached, the normally open valve means closes, blocking communication to the outlet and creating a static pressure head against the piston assembly. Since the pressure has increased, the piston assembly is moved from the first to the second position, carrying with it the actuator which thus operates the throttle cable to increase the speed of the internal combustion engine commensurate with the demand created by the nozzle gun.

In the preferred embodiment, the piston assembly slidably moves relative to the fluid outlet, opening the outlet with the piston assembly in its first position. IN the second position of the piston assembly, however, the fluid outlet is blocked, which prevents system pressure at the outlet from being exerted on the normally open valve means, which would otherwise adversely affect its function.

From the operational standpoint, the inventive apparatus makes the starting function of the internal combustion engine much easier. At the same time, controlling engine speed as a function of nozzle gun demand, and recirculating water in the system at a low flow rate in the non-demand state produces a number of advantages. First, the problem of excessive heat in the system is reduced substantially. Second, life of the internal combustion engine is increased, since it operates at higher speeds only on demand; and conversely, does not operate at high speed in the non-demand state period. Third, fuel economy is increased because the engine operates at idling speed in the non-demand state. Last, the operational noise level is reduced significantly when the system is in the non-demand state and the engine is at an idling speed.

As will be appreciated from the drawings and detailed description, the inventive device uniquely provides this dual function with structure that is mechanically simple, the manufacture of which is economical, which will operate for extended periods with little or no maintenance, and which, due to its simplicity, may be easily disassembled and reassembled when maintenance becomes necessary.

DESCRIPTION OF THE PREFERRED EMBODIMENT

Figure 1:
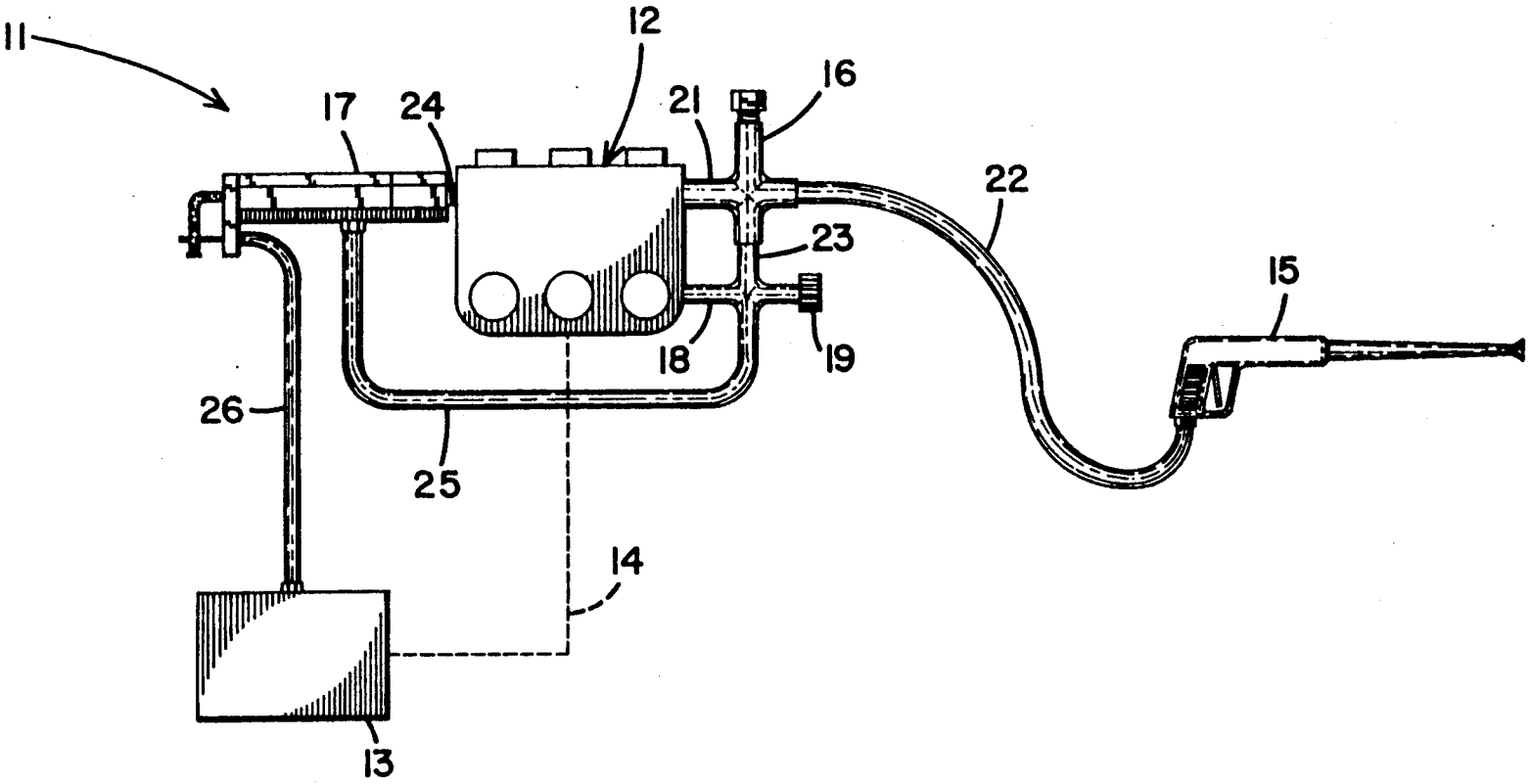
FIG. 1 is a schematic representation of a high pressure washing system utilizing the inventive throttle control device.

With initial reference to FIG. 1, a pressure washing system is represented generally by the numeral 11. System 11 comprises a hydraulic pump 12, an internal combustion engine 13 that drives pump 12 through conventional means represented by dotted line 14, a nozzle gun 15, an unloader valve 16 and a throttle control device 17.

Pump 12 has as a fluid inlet 18 that receives water under pressure from a water source (not shown) through an inlet coupling 19. Pump 12 has a first outlet 21 for discharging water at an increased pressure, and which is connected to the inlet of unloader valve 16. Unloader valve 16 is of conventional construction and may functionally respond to either changes in pressure or flow to nozzle gun 15, which operates in either an "on" or "off" mode. With the nozzle gun 15 in an "on" or operative state, unloader valve 16 delivers pressurized water from the outlet 21 through a hose 22 to gun nozzle 15. When the nozzle gun 15 is in an "off" of inoperative state, unloader valve 16 interrupts the flow of water to hose 22, and bypasses such flow through a connector 23 back to pump inlet 18. Unloader valve 16 is constructed to deliver a minimum of 5% of the flow from pump outlet 21 through the bypass connector 23 to pump inlet 18, and gun nozzle 15 therefore receives a maximum of 95% of the output flow from pump 12.

Pump 12 has a second outlet 24 that is connected to the inlet of throttle control device 17, as will be discussed in further detail below. Throttle device 17 has a bypass outlet, discussed in further detail below, which is connected through a conduit 25 to the pump inlet 18.

Throttle control device 17 functions to provide a progressive mechanical motion in response to water flow from the outlet 24 of increasing pressure, and it actuates a throttle cable 26 to control the speed of internal combustion engine 13.

Figure 2:
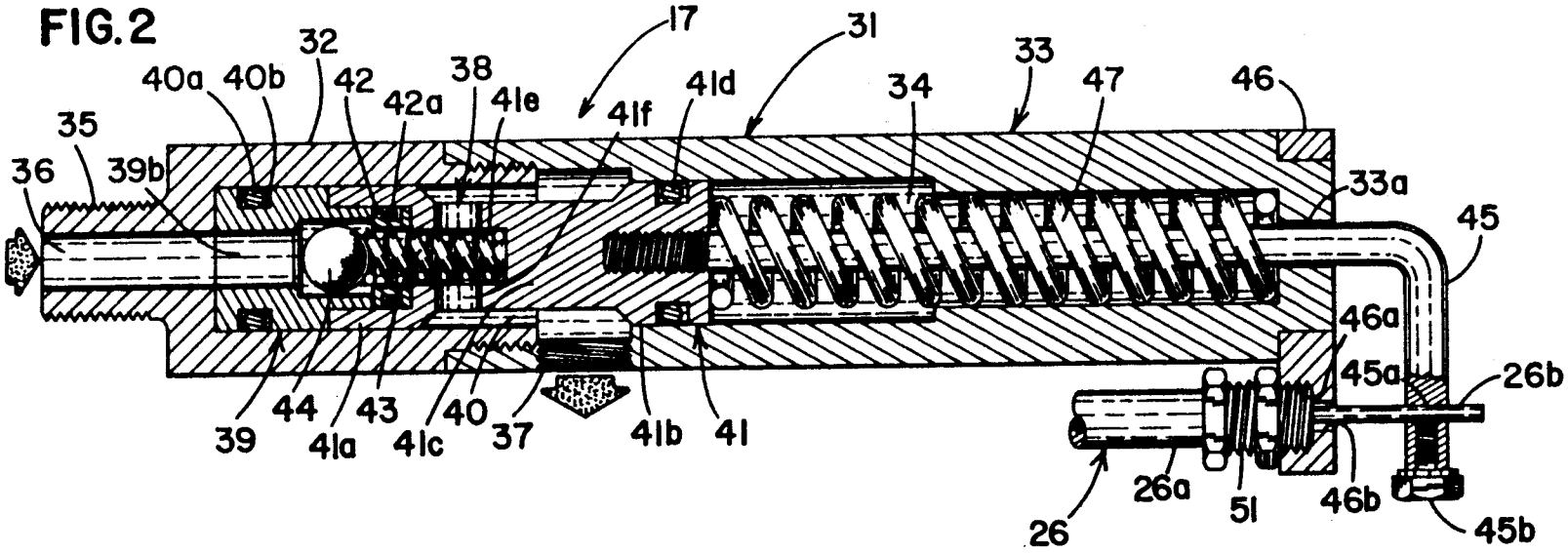
FIG. 2 is an enlarged longitudinal sectional view of the throttle control device in a first position.

With reference to FIG. 2, throttle control device 17 comprises an elongated body 31 having a hexagonal outer surface in the preferred embodiment, and consisting of threadably mating body members 32, 33. Body 31 defines an elongated, stepped internal cylindrical chamber 34. A threaded nipple 35 projects from one end of the body 31 (the left hand end as viewed in FIG. 2) to define a fluid inlet 36, which is connected to the pump outlet 24 as shown in FIG. 1. An outlet 37 is formed through the side of body 31, to which conduit 25 is connected as shown in FIG. 1.

Disposed within the chamber 34 is a piston assembly bearing the general reference numeral 38, consisting of a first piston member 39 and a second piston member 41. Piston member 39 is formed with an external annular channel to receive an O-ring 40*a* and TelCom backup ring 40*b* that sealably and slidably engages the internal cylindrical wall of chamber 34. A stepped bore 39*b* extends through piston member 39, having a diameter at its left end corresponding to that of the inlet 36 and increasing to a larger diameter at the right end.

Piston member 41 generally takes the form of a spool member, having an enlarged left end 41*a*, an enlarged right end 41*b* and an interconnecting portion 41*c* of lesser diameter that defines an annular gap 40 therebetween.

The enlarged right end 41*b* is formed with an external annular groove to receive an O-ring 41*d*. The enlarged left end 41*a* is formed with a relatively large axial recess that mateably receives the stepped right end of piston member 39. Trapped within this recess between the piston members 39, 41 is an annular valve seat 42 which is also formed with an annular groove to receive an O-ring 42*a*.

A smaller axial recess 41*e* extends inward from the left end 41*a* to define a fluid passage, and which also receives a compression spring 43. A ball 44 is disposed in the larger portion of passage 39*b* and is normally urged away from the valve seat 42 by the spring 43.

A transverse passage 41*f* is formed through the interconnecting portion 41*c* of piston 41, traversing the recess 41*e*. As such, and with the piston assembly 38 in the position shown in FIG. 2, water under pressure from pump 12 enters the inlet 36, passes around the ball 44, through the seat 42, the recess 41*e*, transverse passage 41*f*, annular gap 40 and out of the outlet 37.

The extreme right end of piston member 41 is formed with a threaded bore that receives the threaded end of an elongated connecting rod 45. Connecting rod 45 is sufficiently long that it projects through an axial opening 33*a* in the body member 33 regardless of the position of piston 41. The external portion of rod 45 is formed with a 90° bend as shown.

The extreme right end of body member 33 is stepped down to receive a cable retainer 46 for throttle cable 26. Throttle cable 26 is of conventional construction, consisting of a stationary cable sheath 26*a* and a control cable 26*b* that slides within the sheath 26*a*. The cable retainer 46 includes a recess or a threaded socket 46*a* for retainably receiving the end of sheath 26*a*, and a passage 46*b* beginning at the base of socket 46*a* through which the control cable 26*b* projects.

A threaded fitting 51 secured to the end of sheath 26*a* screws into threaded socket 46*a*, and a locknut screwed onto the fitting 51 and bearing against the retainer 46 ensures that the sheath 26*a* will be retained.

Connecting rod 45 is formed with a transverse bore 45*a* through which the cable 26*b* projects, and a set screw 45*b* in the end of rod 45 clamps the cable 26*b* into an adjustable position in the bore 45*a*. As constructed, movement of the piston assembly 38 causes axial movement of the connector rod 45, which results in extension and retraction of the cable 26*b* relative to the sheath 26*a* and thereby controls the throttle of internal combustion engine 13 to vary its speed. The functional relationship between throttle device 17 and engine 13 is such that extension of the connector rod 45, which results from increased fluid pressure at inlet 36 and movement of piston assembly 38 from left to right in FIGS. 2 and 3, causes the speed of engine 13 to increase.

Piston assembly 38 is normally biased to the position shown in FIG. 2 by a coil spring 47 that is compressibly disposed in chamber 34 between the internal right end of body member 33 and the right end of piston assembly 38. As such, the spring force generated by spring 47 must be overcome by the force exerted on piston assembly 38 by fluid pressure in order for piston assembly 38 to be moved.

Figure 3:
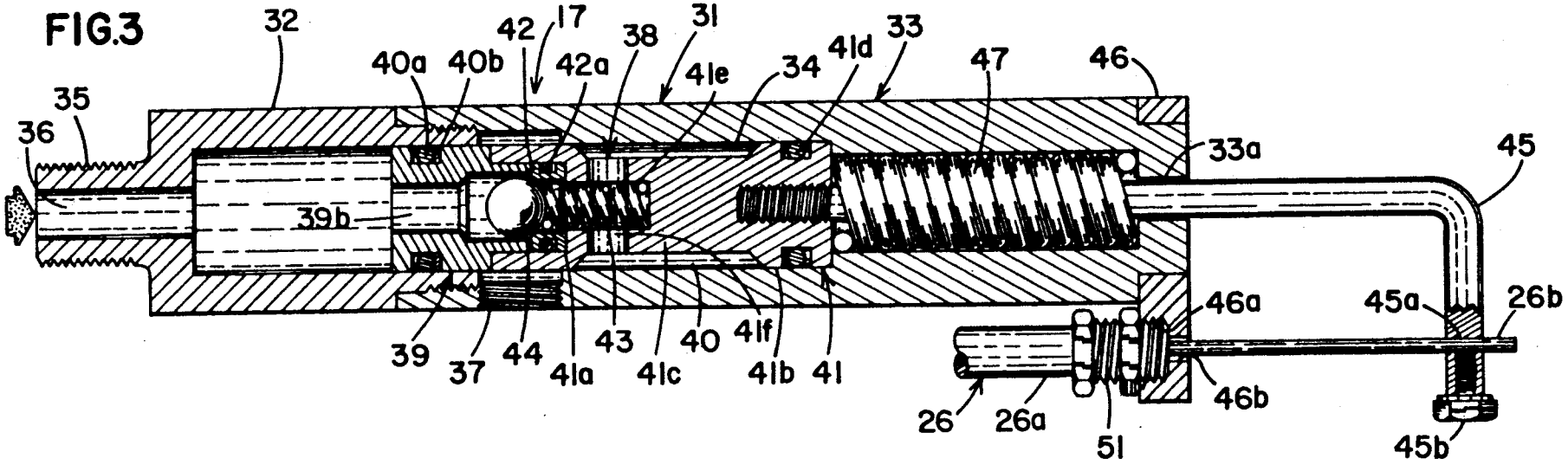
FIG. 3 is a view similar to FIG. 2 with the throttle control device in a second position.

Reference is made to FIGS. 2 and 3 with regard to operation of the throttle control device 17. With water pressure in inlet 36 at a lower level, water flows through inlet 36 and passage 39*b*, around ball 44 and into the axial recess or passage 41*e*. Water then moves radially outward through the transverse passage 41*f* and into the annular gap 40, which leads to outlet 37. Under such conditions, when the pump outlet pressure is low, the piston assembly 38 remains in the position shown in FIG. 2 due to the biasing influence of coil spring 47.

Coil spring 43 and ball 44 are constructed and arranged so that, from this low pressure position, the ball 44 begins to move and seats on the valve seat 42 at a predetermined minimum or threshold pressure (e.g., 85 psi). When this threshold pressure is reached, and ball 44 engages and seats against valve seat 42, passage **41*e* is blocked. As a result, the static pressure now existing in inlet 36 and passage 39*b* act on the seated ball 44 to move the piston assembly 38 from left to right as viewed in FIGS. 2 and 3. As soon as such movement occurs, the left end of piston member 39, which had been abutting the adjacent end of body member 32, moves away from such engagement. Its end surface is thereafter exposed to the increased inlet fluid pressure, which increases the overall force acting on the piston assembly 38. The distance which piston assembly 38 moves depends on the magnitude of fluid pressure at input 36. However, and as described in further detail below, since the nozzle gun 15 in the preferred embodiment operates either in an "on" or "off" mode, piston assembly 38 is either in the position shown in FIG. 2 when nozzle gun 15 is "off", or in the position of FIG. 3 when nozzle gun 15** is "on".

It will be noted that, when piston assembly 38 is in the position shown in FIG. 2, the annular gap 40 is in registration with the outlet 37, which permits the flow of water through device 17 when the threshold pressure for ball 44 has not been reached. However, after piston assembly 38 moves to the position shown in FIG. 3, the annular gap 40 moves beyond and out of registration with the outlet 37. As such, pressure in the conduit 25 leading to outlet 37 is unable to exert a reverse force on the ball 44.

In the overall operation of pressure washing system 11, internal combustion engine 13 must be started and in a running mode in order to drive pump 12. When engine 13 is inoperative, unloader valve 16 is in the bypass mode, which causes the output of pump 12 to be communicated through the unloader valve 16 and back to the pump inlet 18 for recirculation through the pump impeller or piston. As such, the pump 12, acting against the unloader valve 16, represents a load to the engine 13, which makes turnover of the engine 13 difficult, particularly if the engine starting apparatus is manual.

Throttle device 17 alleviates this problem when the piston assembly 38 is in the position shown in FIG. 2. In this mode, water entering inlet 36 passes through throttle device 17 and out its outlet 37, through conduit 25 to pump inlet 18, and it circulates without significant resistance. Internal combustion engine 13 may accordingly be started more easily.

With engine 13 running, throttle device 17 will maintain the position shown in FIG. 2 in the absence of demand from nozzle gun 15. As such, connecting rod 45 will cause control cable **26*b* to be in the retracted position shown, thus maintaining engine 13 at low or idle speed. At the same time, unloader valve 16, not sensing demand from nozzle gun 15, will bypass water discharged from pump outlet 21 back to pump inlet 18. Because engine 13** is at idle speed, water flows through the system at a low flow rate to keep system temperature from increasing rapidly.

When nozzle gun 15 is actuated to the "on" or operative position, unloader valve 16 immediately changes its position, directing water from pump outlet 21 through conduit 22 to gun nozzle 15. Because gun nozzle 15 is a high impedance device, this increases water pressure in the system, which is sensed at inlet 36 of throttle device 17. As this pressure increases, ball 44 is forced onto seat 42 to shut off the bypass flow through outlet 37, and to move piston assembly 38 to the position shown in FIG. 3. As this occurs, connecting rod 45 is extended, likewise extending control cable **26*b* to increase the speed of engine 13 commensurate with the demand of nozzle gun 15. As such, water is delivered to the nozzle gun 15** at a high flow rate.

When nozzle gun 15 is again changed to the "off" or inoperative state, this is sensed by unloader valve 16, which returns to its bypass mode, reducing the pressure in the circulation system including the pressure at inlet 36. As soon as this occurs, spring 47 urges piston assembly 38 back to the position shown in FIG. 2, retracting connecting rod 45 and control cable **26*b* to reduce the speed of engine 13 and the flow rate of the pump 12. At the same time, spring 43 urges ball 44 from seat 42, thus reestablishing the flow from inlet 36 to outlet 37**.

What is claimed is:

1. Control apparatus for producing mechanical motion in response to increasing fluid pressure after a predetermined minimum pressure has been reached, comprising:

a body defining an internal chamber, a fluid inlet leading into the chamber and a fluid outlet leading from the chamber;

piston means disposed in the chamber and movable in response to fluid pressure between first and second positions, said piston means defining fluid passage means disposed between said fluid inlet and said fluid outlet;

actuator means carried by the piston means for producing usable mechanical motion as a function of movement of said piston means;

and pressure actuated, normally open valve means disposed in said passage means for establishing fluid flow between said inlet and outlet in its open mode, and movable to a closed position when pressure at said inlet reaches a predetermined level to block fluid flow between the inlet and outlet, the valve means comprising a ball member, an annular seat member disposed in the passage means and forming part thereof, and spring means for urging the ball away from the seat member;

the piston means and valve means being together constructed and arranged so that, when the valve means closes and fluid flow is blocked, the piston means is movable from the first to the second position by fluid pressure at said inlet, whereby the actuator means is moved.

2. The apparatus defined by claim 1, wherein the piston means is biased by spring means toward said first position, the piston means being movable by the spring means from the second to the first position when pressure at said inlet falls below said predetermined level and fluid flow is re-established between said inlet and outlet.

3. The apparatus defined by claim 1, wherein the piston means and outlet are relatively disposed so that the piston means establishes fluid communication between the outlet and the outlet side of the valve means in said first position, and blocks fluid communication therebetween in said second position.

4. The apparatus defined by claim 1, wherein the piston means comprises a spool-shaped member having first and second enlarged ends sealably slidable in said chamber and an interconnecting portion of lesser cross sectional dimension defining an annular gap with the wall of said chamber, said annular gap forming part of said passage means.

5. The apparatus defined by claim 4, wherein the annular gap is disposed in fluid communication with said outlet when the piston means is in said first position, and one of said first and second enlarged ends blocks the outlet with the piston means in said second position.

6. The apparatus defined by claim 5, wherein the fluid passage means further comprises an axial passage extending from the first enlarged end of the piston means and into said interconnecting portion, and a transverse passage establishing fluid communication between said axial passage and said annular gap.

7. The apparatus defined by claim 6, which further comprises spring means disposed in said chamber between the second enlarged end of the piston means and the end of said chamber for biasing the piston means toward said first position.

8. The apparatus defined by claim 7, wherein the actuator means comprises a rod member carried by the piston means and projecting externally of the body.

9. The apparatus defined by claim 8, wherein the rod member projects axially from the second enlarged head of the piston means through an axial end of the body.

10. The apparatus defined by claim 9, wherein the spring means comprises a coil spring encircling the rod member.

11. In a hydraulic system including hydraulic pumping means, variable speed motor means operably connected to drive the hydraulic pumping means and including throttle cable means actuatable to vary the speed of said motor means, the hydraulic pumping means having an inlet connected to a source of hydraulic fluid, an outlet for delivering pressurized hydraulic fluid, a utility device having demand and non-demand states connected to the pump outlet for utilizing the pressurized fluid, and unloader valve means disposed between the pump outlet and utility device for establishing fluid communication between the pumping means outlet and utility device when the utility device is in a demand state, and for causing hydraulic fluid to be recirculated from the pumping means outlet to the pumping means inlet when the utility device is in a non-demand state, the improvement which comprises:

a body defining an internal chamber, a fluid inlet leading into the chamber and a fluid outlet leading from the chamber;

first conduit means connecting the pumping means outlet with said fluid inlet and second conduit means connecting the fluid outlet to the pumping means inlet;

piston means disposed in the chamber and movable in response to fluid pressure between first and second positions;

actuator means carried by the piston means and movable as a function of movement of said piston means, the actuator means being operably connected to the throttle cable means;

and pressure actuated, normally open valve means disposed in the chamber for establishing fluid flow between said inlet and outlet in its open mode, and movable to a closed position when pressure at said inlet reaches a predetermined level to block fluid flow between the inlet and outlet;

the piston means and valve means being together constructed and arranged so that, when the valve means closes and fluid flow is blocked, the piston means is movable from the first to the second position by inlet fluid pressure, whereby the actuator means is moved to vary the speed of said motor means.

12. The hydraulic system defined by claim 11, in which the speed of the motor means is increased as the actuator means is moved with movement of the piston means from the first to the second position.

13. The hydraulic system defined by claim 12, wherein the piston means is biased by spring means toward said first position, the piston means being movable by the spring means from the second to the first position when pressure at said inlet falls below said predetermined level and fluid flow is re-established between said inlet and outlet.

14. The hydraulic system defined by claim 11, wherein the piston means and outlet are relatively disposed so that the piston means establishes fluid communication between the outlet and the outlet side of the valve means in said first position, and blocks fluid communication therebetween in said second position.

15. The hydraulic system defined by claim 11, wherein the throttle cable means comprises a stationary sheath and a control cable slidable therein, a sheath retaining member is secured to the body member to maintain its stationary position, and the actuator means is operably connected to the control cable.

16. The hydraulic system defined by claim 11, wherein the utility device is a nozzle gun actuatable between operative and inoperative positions, and the hydraulic fluid is water.

17. A high pressure washer system comprising:

hydraulic pumping means having an inlet adapted for connection to a source of water under pressure and an outlet for delivering pressurized water, variable speed motor means operably connected to drive the hydraulic pumping means;

a nozzle gun having demand and non-demand states connected to the pump outlet for utilizing the pressurized water;

unloader valve means disposed between the pump outlet and nozzle gun for establishing fluid communication there between when the nozzle gun is in a demand state, and for causing pressurized water to be recirculated from the pumping means outlet to the pumping means inlet when the nozzle gun is in a non-demand state; and motor speed control means for causing the motor means to operate at a predetermined operational speed with the nozzle gun in a demand state to cause water to be delivered to the nozzle gun at a predetermined delivery rate, and to operate at a predetermined idling speed lower than said operational speed with the nozzle gun in a non-demand state to cause water to be recirculated at a flow rate less than said delivery rate.

* * * * *